US012172732B1

(12) United States Patent
Farrell et al.

(10) Patent No.: US 12,172,732 B1
(45) Date of Patent: Dec. 24, 2024

(54) SWIM PLATFORM ASSEMBLIES FOR BOATS

(71) Applicant: Brunswick Corporation, Mettawa, IL (US)

(72) Inventors: Kevin T. Farrell, New Smyrna Beach, FL (US); Kristin M. McGinnis, Cocoa Beach, FL (US); Carrie A. Fodor, Cape Canaveral, FL (US)

(73) Assignee: Brunswick Corporation, Mettawa, IL (US)

( * ) Notice: Subject to any disclaimer, the term of this patent is extended or adjusted under 35 U.S.C. 154(b) by 641 days.

(21) Appl. No.: 17/350,555

(22) Filed: Jun. 17, 2021

(51) Int. Cl.

| | |
|---|---|
| ***B63B 27/14*** | (2006.01) |
| ***B63B 3/48*** | (2006.01) |
| ***B63B 7/02*** | (2020.01) |
| ***B63B 29/02*** | (2006.01) |

(52) U.S. Cl.
CPC ..... *B63B 27/146* (2013.01); *B63B 3/48* (2013.01); *B63B 7/02* (2013.01); *B63B 27/14* (2013.01); *B63B 27/143* (2013.01); *B63B 2027/141* (2013.01); *B63B 2027/148* (2013.01); *B63B 2029/022* (2013.01)

(58) Field of Classification Search
CPC . B63B 27/14; B63B 2027/141; B63B 27/146; B63B 2027/148; B63B 2029/022; B63B 27/143
See application file for complete search history.

(56) References Cited

U.S. PATENT DOCUMENTS

| | | | |
|---|---|---|---|
| 2,158,949 | A | 5/1939 | Sarles et al. |
| 2,174,622 | A | 10/1939 | Dale |
| 2,493,639 | A | 1/1950 | Pellegrini |
| 2,809,849 | A | 10/1957 | Benne |
| 2,825,582 | A | 3/1958 | McDonald |
| 3,195,680 | A | 7/1965 | Thornburg, Sr. et al. |
| 3,394,947 | A | 7/1968 | Strube, Sr. |

(Continued)

FOREIGN PATENT DOCUMENTS

| | | |
|---|---|---|
| CN | 105599867 | 5/2016 |
| CN | 206615350 | 11/2017 |

(Continued)

OTHER PUBLICATIONS

Swim Platform UTRA—Brand New Built-in Retractable Bench!, announced in YouTube on Mar. 12, 2018 [online], [site visited Apr. 13, 2023], available from the internet URL: https://www.youtube.com/watch?v=dRHH4rTha7U.

(Continued)

*Primary Examiner* — Ajay Vasudeva

(74) *Attorney, Agent, or Firm* — Andrus Intellectual Property Law, LLP

(57) ABSTRACT

A modular swim platform assembly is for a boat. The assembly has a deck that is movable relative to the boat into and between a retracted position and an extended position, wherein the deck is located closer to the boat in the retracted position than the extended position. The deck has a base platform and a submersible platform, the submersible platform being movable out of the extended position while the base platform remains in the extended position, and particularly wherein the submersible platform is movable out of the extended position to a deployed position that is below the base platform.

29 Claims, 9 Drawing Sheets

(56) References Cited

U.S. PATENT DOCUMENTS 3,462,170 A 8/1969 Smith et al.
3,501,190 A 3/1970 McCrea
3,507,515 A 4/1970 Brammer
3,580,613 A 5/1971 Northrop
3,627,350 A 12/1971 Cross
3,716,254 A 2/1973 Tarvin
3,756,622 A 9/1973 Pyle et al.
3,774,720 A 11/1973 Hovey
3,799,288 A 3/1974 Manuel et al.
3,825,097 A 7/1974 Owen
3,861,713 A 1/1975 McKee
3,892,290 A 7/1975 Lang
3,927,903 A 12/1975 Jones
3,986,503 A 10/1976 Le Guillon
4,021,071 A 5/1977 Norman
4,174,115 A 11/1979 Youngblood
4,180,143 A 12/1979 Clugston
4,191,388 A 3/1980 Barksdale
4,194,754 A 3/1980 Hightower
4,198,070 A 4/1980 Weiler
4,275,664 A 6/1981 Reddy
4,293,967 A 10/1981 Ord
4,391,453 A 7/1983 Glaser
4,432,436 A 2/1984 Suiter
4,462,485 A 7/1984 Terry et al.
4,556,125 A 12/1985 Johnson
4,605,098 A 8/1986 Leuty
4,623,160 A 11/1986 Trudell
4,712,503 A 12/1987 Ritten
4,722,419 A 2/1988 Hoszowski
4,724,925 A 2/1988 Ritten
4,726,317 A 2/1988 Ritten et al.
4,733,752 A 3/1988 Sklar
4,742,795 A 5/1988 Deprey et al.
4,750,753 A 6/1988 Dezern
4,799,447 A 1/1989 Hebert et al.
4,819,987 A 4/1989 Stringer
4,823,910 A 4/1989 Day
4,846,487 A 7/1989 Criley
4,907,673 A 3/1990 Ginter et al.
4,926,965 A 5/1990 Fox
4,930,797 A 6/1990 Parrill
4,993,109 A 2/1991 Stevens
5,014,640 A 5/1991 Owen, Sr.
5,028,063 A 7/1991 Andrews
5,039,119 A 8/1991 Baughman
5,085,164 A 2/1992 Whitton
5,123,372 A 6/1992 Kobayashi et al.
5,152,244 A 10/1992 Jarmillo, Jr. et al.
5,222,456 A 6/1993 Friedrich
5,294,175 A 3/1994 Elton
5,435,260 A 7/1995 Granie et al.
5,458,080 A 10/1995 Jaramillo, Sr.
5,537,949 A 7/1996 Blevins et al.
5,549,312 A 8/1996 Garvert
5,560,679 A 10/1996 Barnholdt
5,572,944 A 11/1996 Slikkers et al.
5,584,733 A 12/1996 Kobayashi
5,632,224 A 5/1997 Schneider
5,647,632 A 7/1997 Fireman
5,732,996 A 3/1998 Graffy et al.
5,788,311 A 8/1998 Tibbals
5,803,475 A 9/1998 Dick
5,927,433 A 7/1999 Jaramillo, Sr.
5,970,905 A 10/1999 Jaramillo, Sr.
5,970,906 A 10/1999 Hrescak et al.
6,019,050 A 2/2000 Ranta
6,021,733 A 2/2000 Jaramillo, Sr.
6,058,875 A 5/2000 Krish, Jr.
6,082,751 A 7/2000 Hanes et al.
6,119,809 A 9/2000 McClendon, Jr.
6,145,865 A 11/2000 Cannara et al.
6,170,093 B1 1/2001 Kowalski
6,170,842 B1 1/2001 Mueller
6,182,598 B1 2/2001 Bozzo
6,213,486 B1 4/2001 Kunz et al.
D445,076 S 7/2001 Weinerman
6,270,106 B1 8/2001 Maki et al.
6,327,992 B1 12/2001 Martin
6,533,303 B1 3/2003 Watson
6,578,510 B1 6/2003 Scruggs et al.
6,588,839 B1 7/2003 Salzer
6,631,938 B1 10/2003 Burns
6,793,039 B2 9/2004 Schmid, Jr.
6,904,863 B2 6/2005 Mardikian et al.
6,905,158 B1 6/2005 Bastian
6,942,272 B2 9/2005 Livingston
6,966,597 B2 11/2005 Tegtmeier
7,055,838 B2 6/2006 Lambie
7,059,648 B2 6/2006 Livingston
7,121,226 B2 10/2006 Grimaldi
7,162,969 B2 * 1/2007 Houlder ..... B63B 27/14 114/362
7,182,175 B1 2/2007 Schmitt et al.
7,237,503 B2 7/2007 Stepp
7,314,019 B1 1/2008 Curi et al.
7,341,016 B2 3/2008 Terleski et al.
7,377,563 B1 5/2008 Demick
7,401,833 B2 7/2008 Dryja
7,410,031 B2 8/2008 Jensen
7,416,238 B2 8/2008 Houston
7,434,825 B2 10/2008 Williams
7,475,652 B2 1/2009 Dvorak
7,503,276 B1 3/2009 Curi et al.
7,607,400 B2 10/2009 Scotti
7,735,894 B2 6/2010 King et al.
7,766,357 B2 8/2010 Arvanites
7,896,419 B2 3/2011 Elliott et al.
7,900,575 B2 3/2011 Walbridge et al.
7,946,243 B1 5/2011 Ulrich
8,056,496 B1 11/2011 Bussa
8,075,008 B1 12/2011 Hanser et al.
D653,174 S 1/2012 Parvey
8,297,215 B1 10/2012 Chinn
8,375,880 B1 2/2013 St. Clair, Jr et al.
8,434,420 B2 5/2013 Muller
8,444,225 B2 5/2013 Behe
8,479,677 B2 7/2013 Bolline et al.
8,522,922 B1 9/2013 Stokes
8,523,285 B2 9/2013 Wihinen
8,539,896 B2 9/2013 Bolline et al.
8,636,110 B2 1/2014 Ebbenga et al.
8,646,400 B2 2/2014 Grimaldi
8,671,869 B2 * 3/2014 Muller ..... B63B 27/146 114/362
D706,205 S 6/2014 Bradley
D710,288 S 8/2014 Dorton et al.
8,813,672 B2 8/2014 Nelson
D713,772 S 9/2014 Ziaylek et al.
8,833,290 B2 9/2014 Mueller
D717,713 S 11/2014 Whalen
8,899,169 B1 12/2014 Jaziri
8,905,354 B2 12/2014 Griffiths et al.
D726,635 S 4/2015 Curts
9,016,228 B2 4/2015 Dorton et al.
9,102,384 B2 8/2015 Pierce et al.
9,120,540 B1 9/2015 Foss et al.
D742,804 S 11/2015 Kim
9,205,896 B2 * 12/2015 Mueller ..... B63B 27/14
D748,561 S 2/2016 Canela
9,586,655 B1 3/2017 Butler
9,592,887 B2 3/2017 Frabetti
D806,625 S 1/2018 Hoffman et al.
9,937,979 B1 4/2018 Holmes
9,944,360 B2 * 4/2018 Franklin ..... B63B 17/00
10,017,235 B2 * 7/2018 Pappas ..... B63H 20/02
10,086,913 B2 10/2018 Fafard
10,106,227 B2 10/2018 Allender
D833,358 S 11/2018 Lu
10,308,320 B1 * 6/2019 O'Neal ..... B63B 35/38
10,351,215 B2 7/2019 Scozzoli
10,399,645 B1 9/2019 Holmes
10,501,151 B2 12/2019 Allender
D877,302 S 3/2020 Hyde

(56) References Cited

U.S. PATENT DOCUMENTS

| | | | |
|---|---|---|---|
| 10,703,446 | B2 | 7/2020 | Ricciardi et al. |
| D896,459 | S | 9/2020 | Eilmus et al. |
| 10,822,059 | B2 | 11/2020 | Miller |
| 11,401,011 | B2 | 8/2022 | Johns |
| 2002/0003340 | A1 | 1/2002 | Hallquist |
| 2002/0070577 | A1 | 6/2002 | Pool et al. |
| 2003/0070875 | A1 | 4/2003 | Medsker |
| 2004/0160079 | A1 | 8/2004 | Harper et al. |
| 2004/0256833 | A1 | 12/2004 | Cervenka |
| 2005/0046219 | A1 | 3/2005 | Livingston |
| 2008/0277958 | A1 | 11/2008 | King et al. |
| 2009/0078188 | A1 | 3/2009 | Thomas |
| 2010/0089697 | A1 | 4/2010 | Kreller |
| 2010/0170430 | A1 | 7/2010 | Gros |
| 2010/0288179 | A1 | 11/2010 | Grimaldi |
| 2011/0023770 | A1 | 2/2011 | Brown |
| 2012/0032418 | A1 | 2/2012 | Doucette et al. |
| 2012/0032490 | A1 | 2/2012 | Nowak et al. |
| 2013/0024074 | A1 | 1/2013 | Baur et al. |
| 2013/0025524 | A1 | 1/2013 | Cooney |
| 2019/0233998 | A1 | 8/2019 | Maynes |
| 2020/0055572 | A1 | 2/2020 | Ricciardi et al. |
| 2020/0055573 | A1 | 2/2020 | Miller |

FOREIGN PATENT DOCUMENTS

| | | | | |
|---|---|---|---|---|
| DE | 1077096 | | 3/1960 | |
| DE | 7401974 | | 4/1974 | |
| DE | 202009007140 | U1 * | 10/2009 | ..... B63B 23/32 |
| DE | 102008057537 | | 5/2010 | |
| DE | 102018133044 | A1 * | 6/2020 | |
| EP | 1216918 | | 6/2002 | |
| EP | 2065301 | A2 * | 6/2009 | ..... B63B 27/143 |
| EP | 3578452 | A1 * | 12/2019 | |
| EP | 3290326 | | 1/2020 | |
| EP | 3771631 | A1 * | 2/2021 | ..... B63B 27/14 |
| FR | 2235040 | | 1/1975 | |
| FR | 2603236 | | 3/1988 | |
| FR | 2689085 | | 10/1993 | |
| GB | 254090 | | 7/1926 | |
| GB | 2476469 | | 6/2011 | |
| WO | WO-2007087736 | A1 * | 8/2007 | ..... B63B 27/14 |
| WO | WO 2009077787 | | 6/2009 | |
| WO | 2011137548 | | 11/2011 | |
| WO | WO 2013036940 | | 3/2013 | |
| WO | WO-2014199314 | A2 * | 12/2014 | ..... B63B 23/30 |
| WO | 2016089333 | | 6/2016 | |
| WO | 2017187369 | | 11/2017 | |

OTHER PUBLICATIONS

Cobalt Innovation—The Swim Stem, announced in YouTube on Nov. 10, 2010 [online], [site visited Apr. 13, 2023], Available from the internet URL: https://www.youtube.com/watch?v=VpmcKS_ytfg.

Motorized Swim Platform + Furry friends = Score!, announced in YouTube on Mar. 28, 2020 [online], [site visited Apr. 13, 2023], Available from the internet URL:https://www.youtube.com/watch?v=M96dosSTLFY.

Bayliner 185, 195, 205, & 225 Runabouts Owner's Manual, 2006.

Four Winns Express Cruisers 2006, retrieved from https://web.archive.org/web/20140712184107/http://fourwinns.com/upload/Documents/Catalogs/2006/Four-Winns-Cruisers-Catalog.pdf on Mar. 13, 2023.

Four Winns Passion for Water: 2009 Sport Boats & Sport Cruisers; retrieved from https://web.archive.org/web/20140712174326/http://fourwinns.com/upload/Documents/Catalogs/2009/Four-Winns-Sport-Boats-Catalog.pdf on Mar. 13, 2023.

Intrepid 327CC; retrieved from https://www.intrepidpowerboats.com/boats/327-valor/ on Mar. 15, 2023.

Munson Bow Door Options, retrieved from https://web.archive.org/web/20150224171602/http://munsonboats.com/bowdoors.php on Mar. 13, 2023.

Sheldon, U.S. Pat. No. 369,129; granted Aug. 30, 1887.

Diving Equipment Specialties: Dive Ladders; retrieved from http://www.techdivetools.com/boat/ladders.html on Mar. 13, 2023.

* cited by examiner

SWIM PLATFORM ASSEMBLIES FOR BOATS

FIELD

The present disclosure relates to swim platform assemblies for boats.

BACKGROUND

The following U.S. Patent is incorporated herein by reference.

U.S. Pat. No. 10,399,645 discloses a manual and submersible auxiliary swim platform for a vessel having a main aft platform, the main aft platform having a recessed area for receiving the auxiliary swim platform. A pair of bracket assemblies secure the auxiliary platform to the main aft platform, and both bracket assemblies have a first bracket member, a second bracket member, and a bushing. The bushing is interposed and secured to the first and second bracket members at a common end. The bracket members and bushing have limiter surfaces which limit rotational and pivotal movement of the bracket assemblies in conjunction with external edges, a pin and interface designs of the bracket assemblies.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A modular swim platform assembly is for a boat. The assembly has a deck that is movable relative to the boat into and between a retracted position and an extended position, wherein the deck is located closer to the boat in the retracted position than the extended position. The deck has a base platform and a submersible platform, the submersible platform being movable out of the extended position while the base platform remains in the extended position, and particularly wherein the submersible platform is movable out of the extended position to a deployed position that is below the base platform.

Various other features, objects, and advantages of the invention will be made apparent from the following description taken together with the drawings.

BRIEF DESCRIPTION OF THE DRAWINGS

The present disclosure refers to the following drawing Figures.

DETAILED DESCRIPTION

Figure 1:
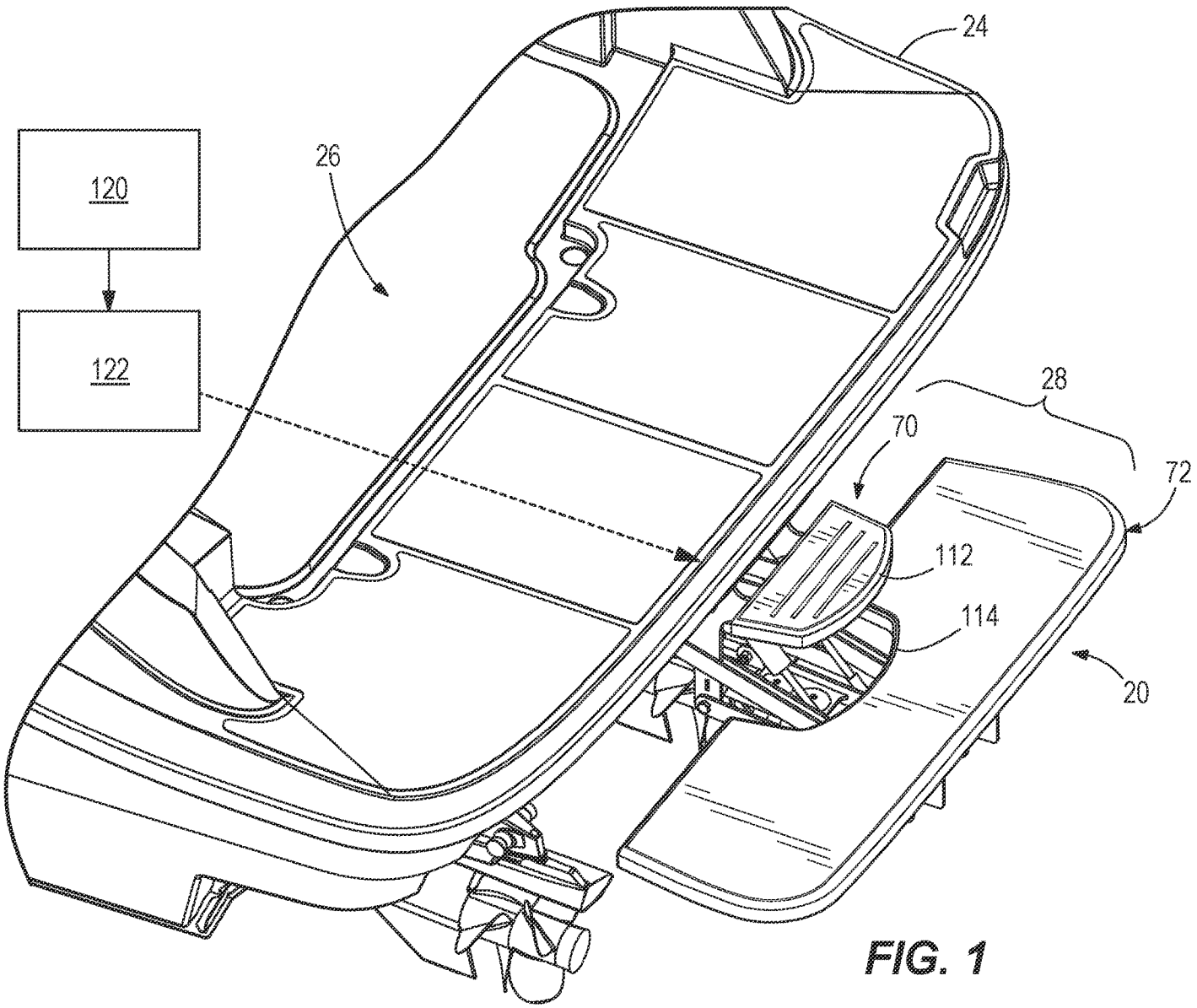
FIG. 1 is a perspective view looking down at a modular swim platform assembly mounted on a stern of a boat.
Figure 2:
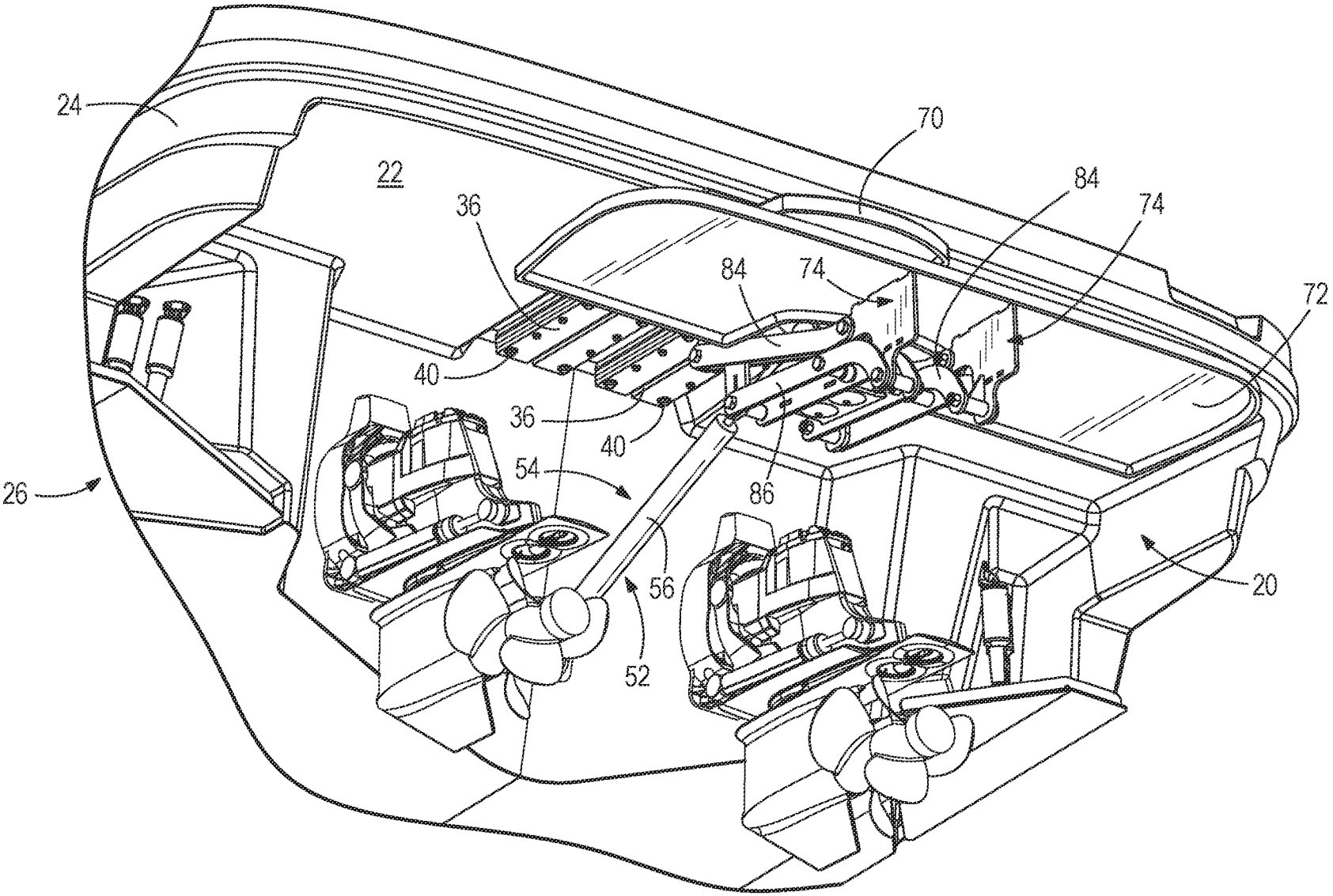
FIG. 2 is a perspective view looking up at the modular swim platform assembly and the stern of the boat.
Figure 3:
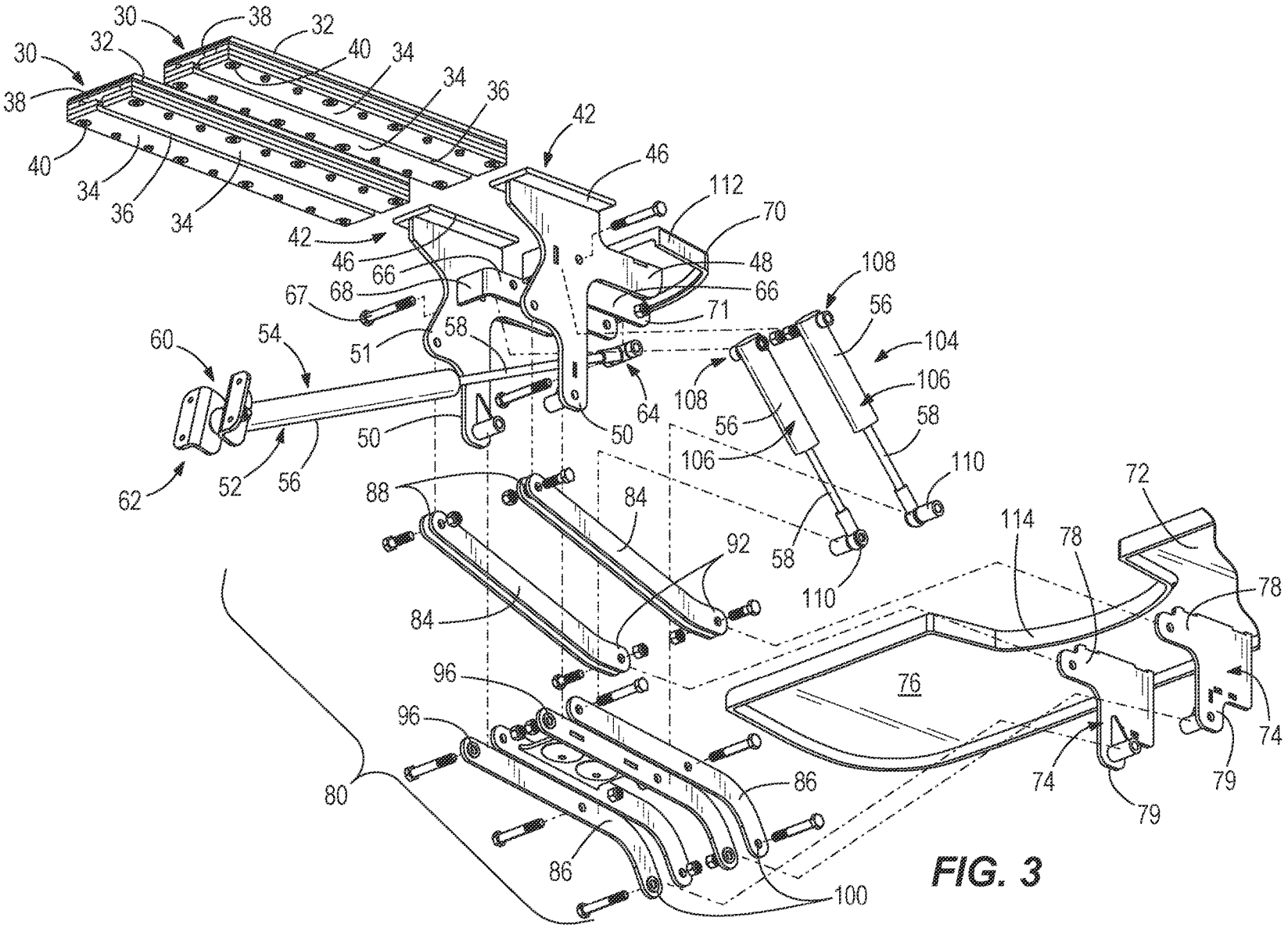
FIG. 3 is an exploded view of the modular swim platform assembly.

FIGS. 1-3 illustrate a modular swim platform assembly 20 according to the present disclosure. The assembly 20 is shown mounted to bottom 22 of a stern 24 of a boat 26, however this is merely exemplary and it should be recognized that depending on the type of boat, the assembly 20 can be mounted to other surfaces of the boat 26, including for example the bow, the port side, or the starboard side of the boat 26. The type and configuration of the boat 26 is exemplary and can vary from what is shown.

The assembly 20 has a deck 28 that is movable relative to the boat 26. The deck 28 is located under the stern 24 in a retracted position (See FIG. 10). FIGS. 1 and 2 illustrate the deck 28 in an extended position, projecting outwardly from the stern 24 and providing a platform for standing. The deck 28 is located closer to the boat 26 in the retracted position than in the extended position.

Referring to FIG. 3, the assembly 20 has opposing mounting brackets 30 that are fixed to the bottom 22 of the stern 24. The mounting brackets 30 support the assembly 20 in all positions, including the above-described retracted and extended position. Each mounting bracket 30 has a base plate 32 and opposing slide rails 34 that are fixed to the base plate 32. An elongated slot 36 is defined between the slide rails 34 and generally extends along the length of the mounting bracket 30. An elongated recess 38 is formed between the base plate 32 and the slide rails 34. The slide rails 34 are fastened to the base plate 32 by fasteners 40. Optionally, the mounting brackets 30 can be made of aluminum and stainless-steel pressed against a Delrin AF material.

Figure 4:
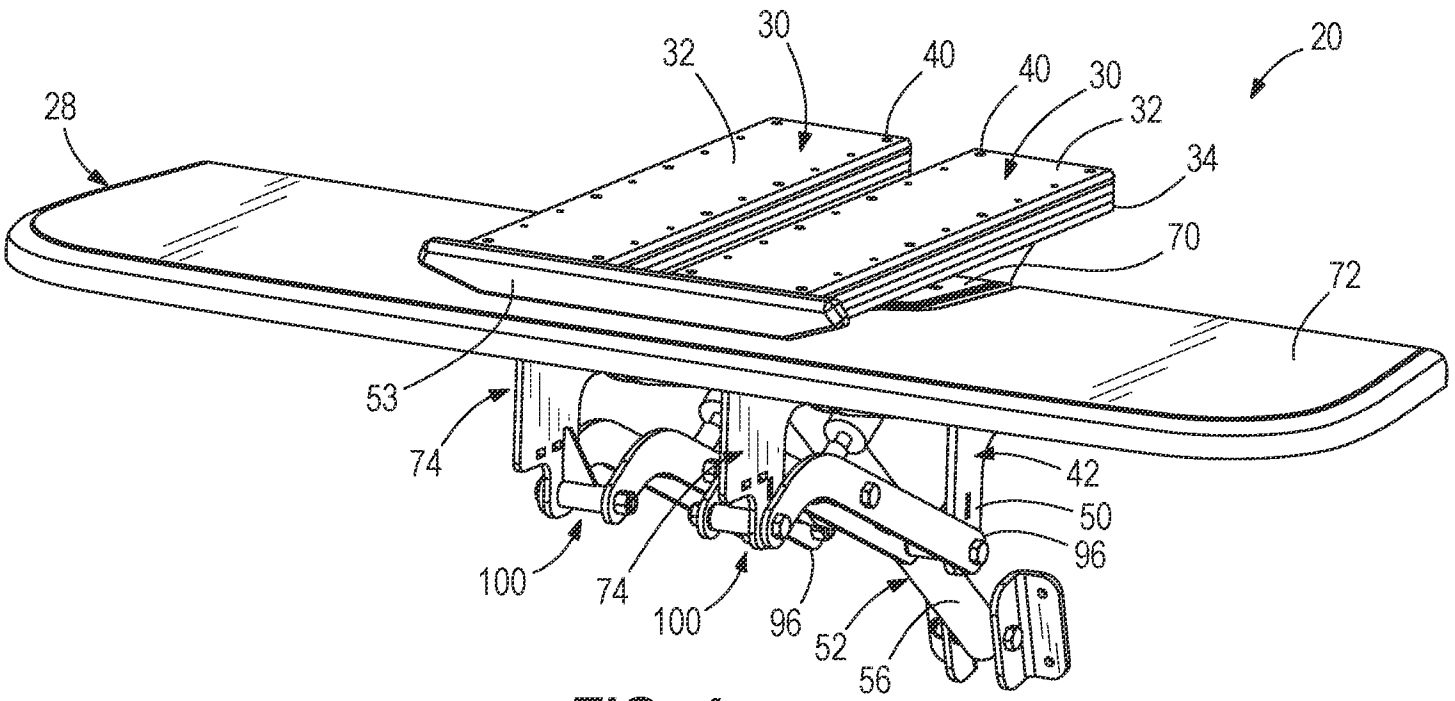
FIG. 4 is a perspective view of the modular swim platform assembly in a retracted position.

The assembly 20 also has a pair of slidable base frames 42. Each base frame 42 has an upper end with a T-profile 46, a rearwardly extending supporting arm 48, a downwardly extending supporting arm 50, and a forwardly extending supporting arm 51 located between the rearwardly extending supporting arm 48 and the downwardly extending supporting arm 50. The T-profile 46 is disposed in the recess 38 and protrudes through the slot 36 of the corresponding mounting bracket 30. The base frames 42 are thus slide-able along the length of the recess 38, permitting sliding movement of the assembly 20 into and out of the extended and retracted positions shown in FIGS. 1 and 2. As shown in FIG. 4, an end cap 53 on the mounting brackets 30 limits outward sliding movement of the base frames 42 past the depicted extended position.

Referring to FIG. 3, an extension actuator 52 is configured to automatically extend and retract the assembly 20 into and out of the extended and retracted positions, as will be further described herein below. In the illustrated example, the extension actuator 52 is a hydraulically-actuated linear actuator having a cylinder 56 and a piston rod 58 that is extendible and retractable relative to the cylinder 56 under force of pressurized hydraulic fluid. Each extension actuator 52 has a first end 60 coupled to the stern 24 by a mounting bracket 62 having two bracket halves. The mounting bracket 62 facilitates pivoting of the first end 60 relative to the stern 24. Each linear actuator 54 also has a second end 64 that is pivotably coupled to the base frame 42 via an L-bracket 66 by a fastener 67. The L-bracket 66 projects rearwardly alongside the rearwardly extending supporting arm 48 and has a rearward end 68 that is fixed to an inside surface of the base frame 42 and a forward end 71 to which the second end 64 of the linear actuator 54 is pivotally coupled. As will be further described herein below, extension of the linear actuator 54 slides the assembly 20 into the extended position and retraction of the linear actuator 54 slides the assembly 20 into the retracted position. The type and configuration of extension actuator 52 can vary from that is shown, and in other examples could comprise any number of hydraulic and/electro-mechanical linear actuators, and/or the like.

Referring to FIGS. 1-3, the deck 28 includes a base platform 70 and a submersible platform 72. As will be further described herein below, the base platform 70 and submersible platform 72 are movable together into and between the extended position and the retracted position. The submersible platform 72 is further pivotable relative to the base platform 70 from the extended position to a deployed position (FIG. 1) that is below the base platform 70. A pair of submersible frames 74 are fixed to the bottom 76 of the submersible platform 72. Referring to FIG. 3, the submersible frames 74 each have a forwardly extending supporting arm 78 and a downwardly extending supporting arm 79.

Now referring to FIG. 3 and FIGS. 8-10, the base platform 70 is fixed on and supported by the rearwardly extending supporting arms 48 of the base frames 42. A pivot linkage 80 pivotably couples the submersible platform 72 to the base frames 42 such that the base platform 70 and submersible platform 72 are movable together into and between the retracted position and the extended position, and further such that the submersible platform 72 is movable relative to the base platform 70 into and between the extended position and the deployed position. The type and configuration of the pivot linkage 80 can vary from what is shown and described. In the illustrated example, the pivot linkage 80 is configured such that the submersible platform 72 pivots along an arc 82 (FIG. 8) from the extended position, initially downwardly and outwardly from the base platform 70 and then downwardly and back inwardly towards the base platform 70.

The pivot linkage 80 has opposing first pivot arms 84 and opposing second pivot arms 86. Each first pivot arm 84 has an inner end portion 88 that is pivotably coupled to the forwardly extending supporting arm 51 of the respective base frame 42 at a first inner pivot point 90. Each first pivot arm 84 further has an outer end portion 92 that is pivotably coupled to the forwardly extending supporting arm 78 of the respective submersible frame 74 at a first outer pivot point 94. Each second pivot arm 86 has an inner end portion 96 that is pivotably coupled to the downwardly extending supporting arms 50 of the respective base frame 42 at a second inner pivot point 98. Each second pivot arm 86 further has an outer end portion 100 that is pivotably coupled to the downwardly extending supporting arm 78 of the respective submersible frame 74 at a second outer pivot point 102. The first pivot arms 84 are located above the second pivot arms 86. Each first pivot arm 84 comprises an elongated upwardly pair of curved bars and each second pivot arm 86 comprises an elongated downwardly pair of curved bars. The pivot points are provided by fasteners secured in through-bores in the pairs of curved bars. The first inner pivot point 90 is located above the second inner pivot point 98. The first outer pivot point 94 is located above the second outer pivot point 102. The first inner pivot point 90 is located forwardly of the second inner pivot point 98. The first outer pivot point 94 is located forwardly of the second outer pivot point 102. Again, the type and configuration of the pivot linkage 80 can vary from what is shown. In the illustrated example, the above-described pivot linkage 80 can be referred to as a four-bar linkage.

A deployment actuator 104 is configured to automatically move the submersible platform 72 into and between the extended position and the deployed position. In the illustrated example, the deployment actuator 104 includes a pair of hydraulically-actuated linear actuators 106, each having a cylinder 56 and a piston rod 58 that is extendible and retractable relative to the cylinder 56 under force of pressurized hydraulic fluid. Each linear actuator 54 has a first end 108 pivotably coupled between the rearward end 68 of the L-bracket 66 and the base frame 42 and a second end 110 pivotably coupled to the respective second pivot arm 86 between the inner and outer end portions 96, 100. The first end 108 is thus positioned vertically higher than the second end 110. Extension of the linear actuators 106 pivots the submersible platform 72 downwardly along the arc 82 into the deployed position. Retraction of the linear actuators 106 pivots the submersible platform upwardly along the arc 82 into the extended position. The type and configuration of extension actuator 52 can vary from that is shown, and in other examples could comprise any number of hydraulic and/electromechanical linear actuators.

Figure 7:
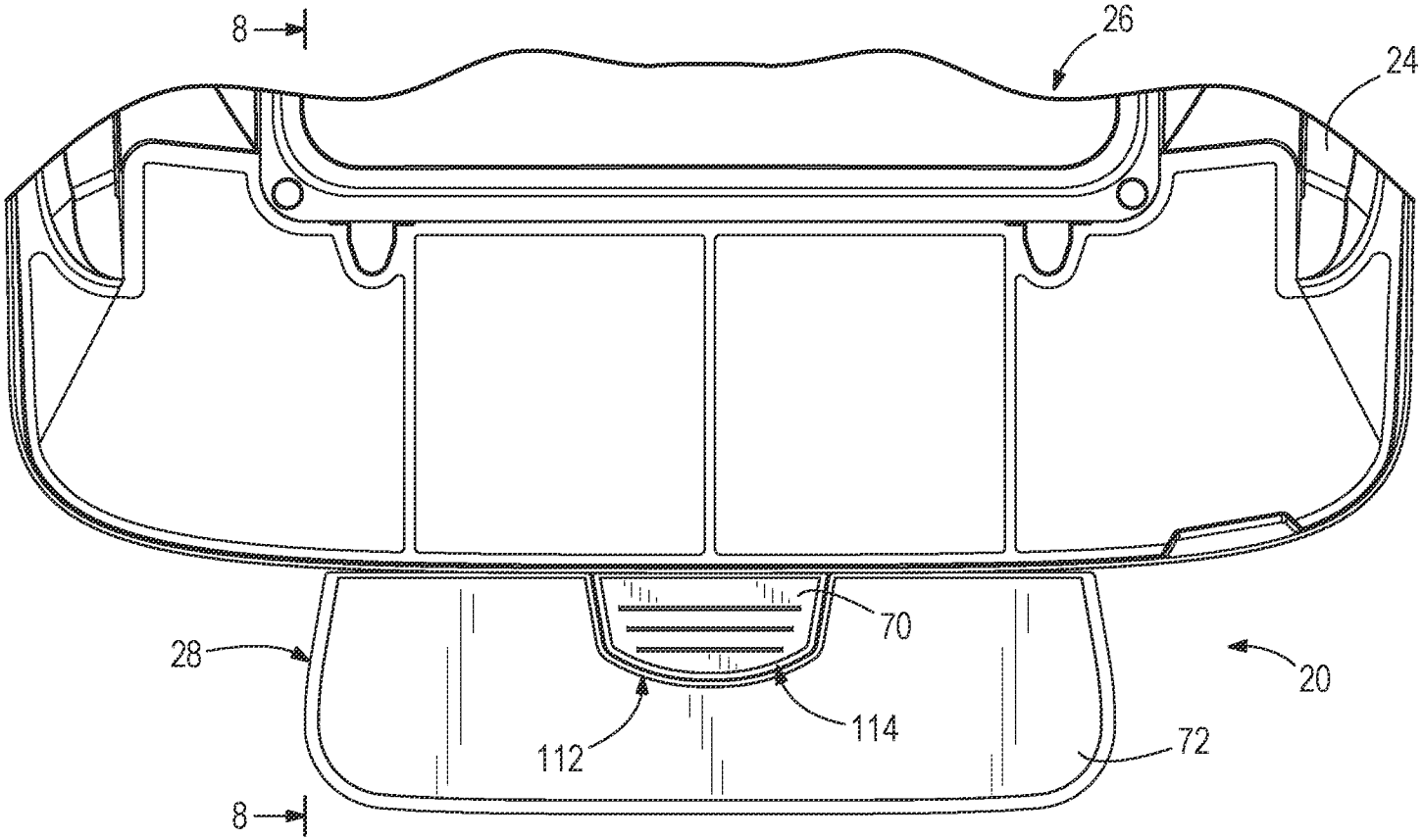
FIG. 7 is a top view of the modular swim platform assembly in either of the extended position or the deployed position.
Figure 8:
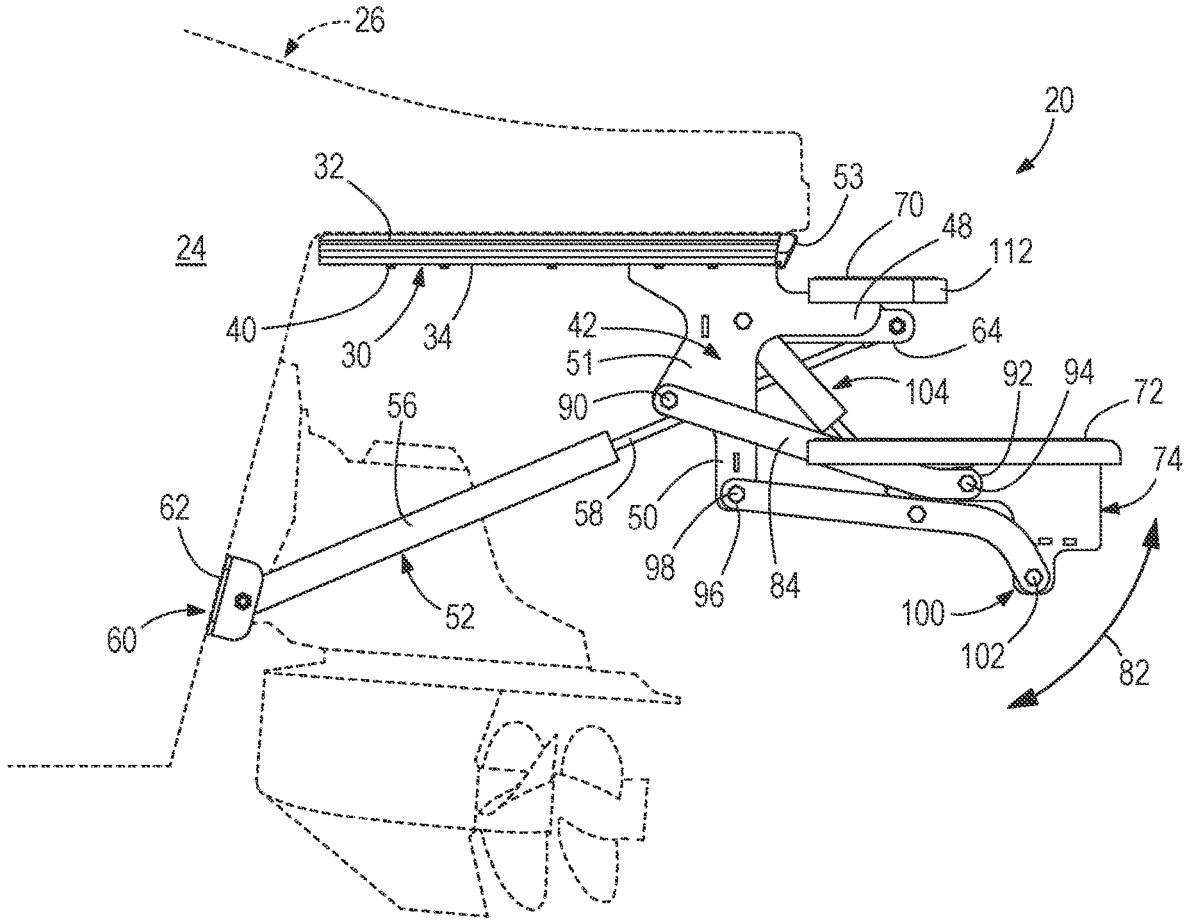
FIG. 8 is a side view of the modular swim platform assembly in the deployed position.

Referring to FIG. 7, base platform 70 has an outer profile 112 having a generally semi-circular shape. The submersible platform 72 has an inner profile 114 having a generally semi-circular shape that follows and is located adjacent to the semi-circular shape of the outer profile 112 such that the base platform 70 and submersible platform 72 provide a contiguous platform surface in the extended position on which an occupant of the boat 26 can stand. With further reference to FIGS. 7 and 8, the pivot linkage 80 is specially configured such that from the extended position the submersible platform 72 is pivotable rearwardly out of lateral alignment with the base platform 70 along the arc 82 and then forwardly or inwardly towards the submersible platform 72 and below but also back into lateral alignment therewith. Thus the assembly 20 appears the same when viewed from the top, see FIG. 7, in both the extended position and the deployed position.

Referring to FIG. 1, the assembly 20 further includes an operator input device 120 configured to control a control system 122. The control system 122 is configured to selectively actuate the extension actuator 52 and the deployment actuator 104 to reposition the assembly 20 into and between the positions shown in the drawings. The control system 122 can be any conventional device for controlling the extension actuator 52 and deployment actuator 104. In examples wherein the extension actuator 52 and deployment actuators 104 are hydraulically actuated, the control system 122 can include one or more conventional hydraulic pumps, valves and/or switching devices for controlling a flow of pressurized hydraulic fluid to the extension actuator and/or deployment actuator 104. However as mentioned above, the actuators do not necessarily have to be hydraulic actuators, and for example can comprise electro-mechanical devices such as one or more electric motors, and/or the like. The type and configuration of operator input device 120 can be any conventional device for inputting a command to or otherwise controlling the control system 122, including for example a mechanical switch, manual lever, push button, joystick, and/or the like. In certain examples, the operator input device 120 can include a touch screen for inputting to a programmable controller for controlling the actuators 52, 104.

Operation of the assembly 20 will now be described with reference to FIGS. 4-10, in sequence. Referring to FIGS. 4 and 10, the assembly 20 is normally positioned in the retracted position when the boat 26 is cruising in open water. As shown, the deck 28 is retracted under the stern 24 via retraction of the extension actuator 25, such that the entire base platform 70 and a majority of or all of the submersible platform 72 are located under the stern 24. The deployment actuator 104 is also retracted, which causes the submersible platform 72 to be laterally aligned with (parallel to and inline with) the base platform 70 and located adjacent to the bottom 22 of the stern 24.

Figure 5:
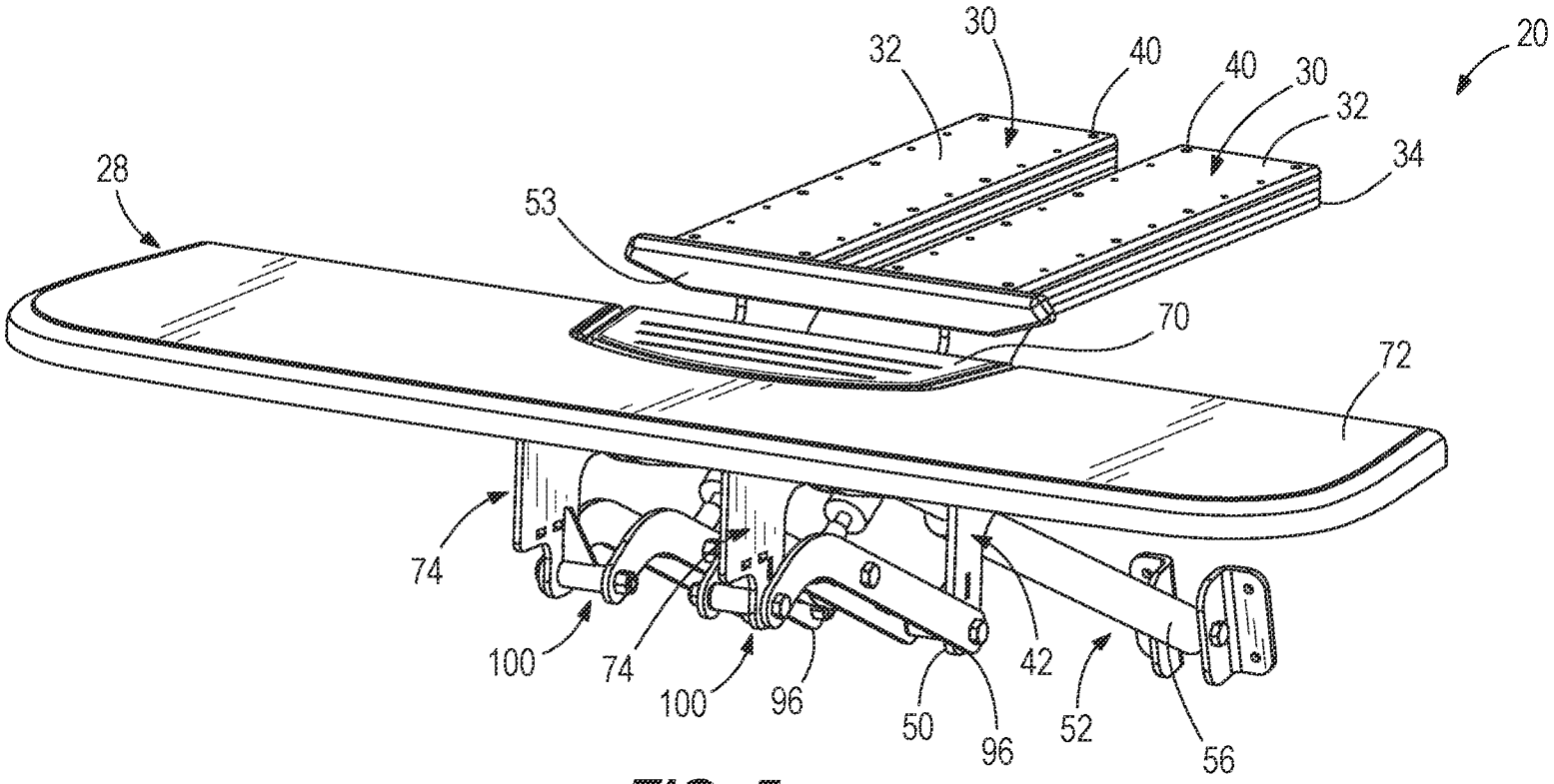
FIG. 5 is a perspective view of the modular swim platform assembly in an extended position.
Figure 9:
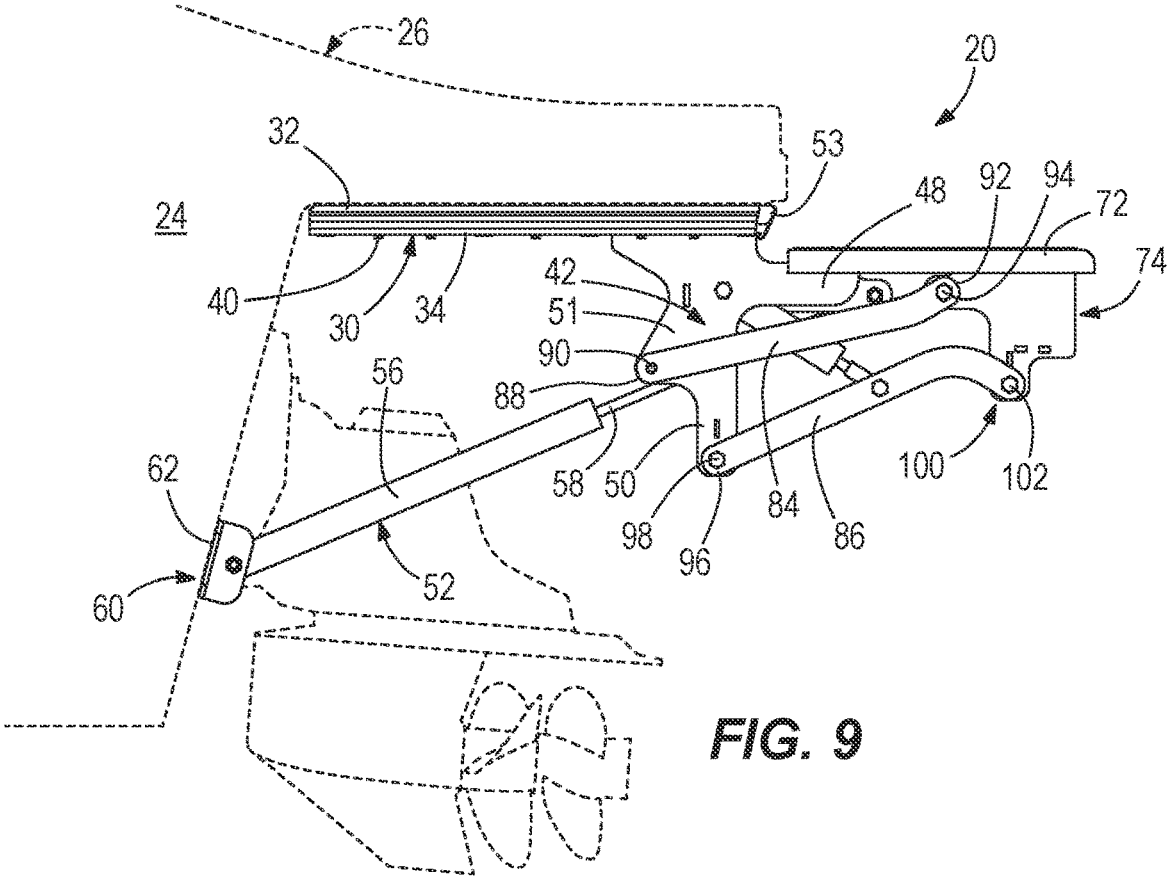
FIG. 9 is a side view of the modular swim platform assembly in the extended position.
Figure 10:
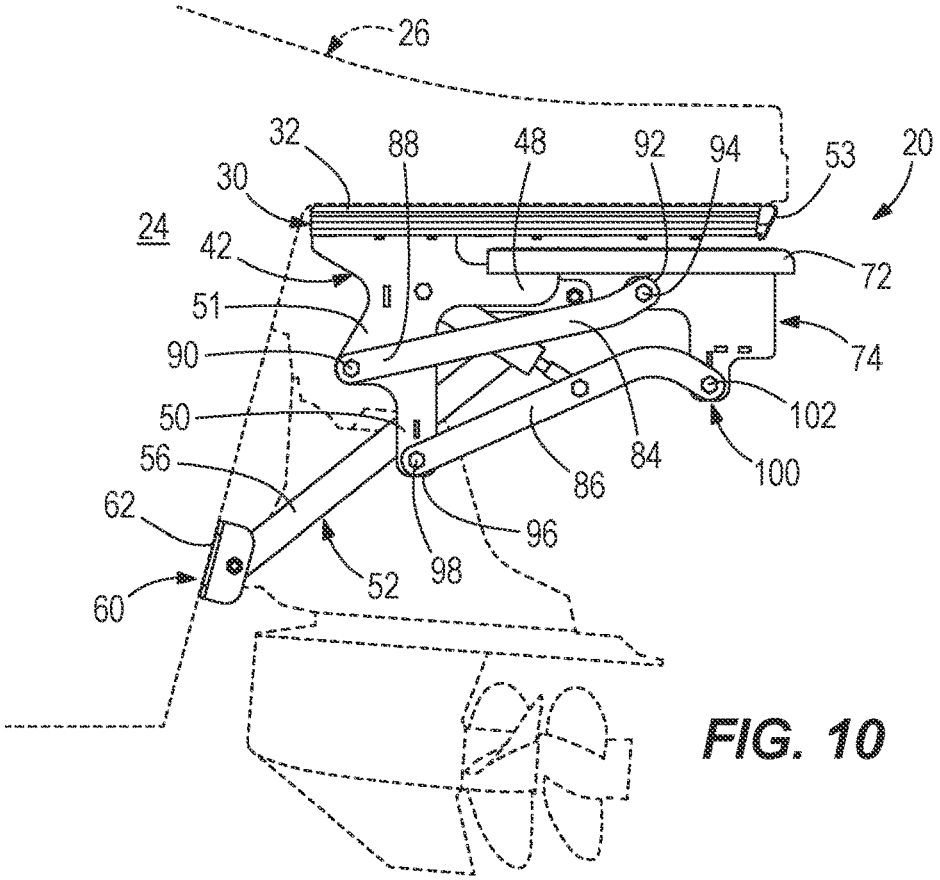
FIG. 10 is a side view of the modular swim platform assembly in the retracted position.

Referring to FIGS. 5 and 9, when for example the boat 26 is at rest, the operator can operate the operator input device 120 to cause the extension actuator 52 to extend the extension actuator 5, which slides the entire deck 28, including the base platform 70 and submersible platform 72 rearwardly, i.e. outwardly relative to the stern 24. The deck 28 is positioned adjacent to the rear of the stern 24, and the base platform 70 and submersible platform 72 remain laterally aligned such that the deck 28 provides an extended platform on which the operator can step onto and stand.

Figure 6:
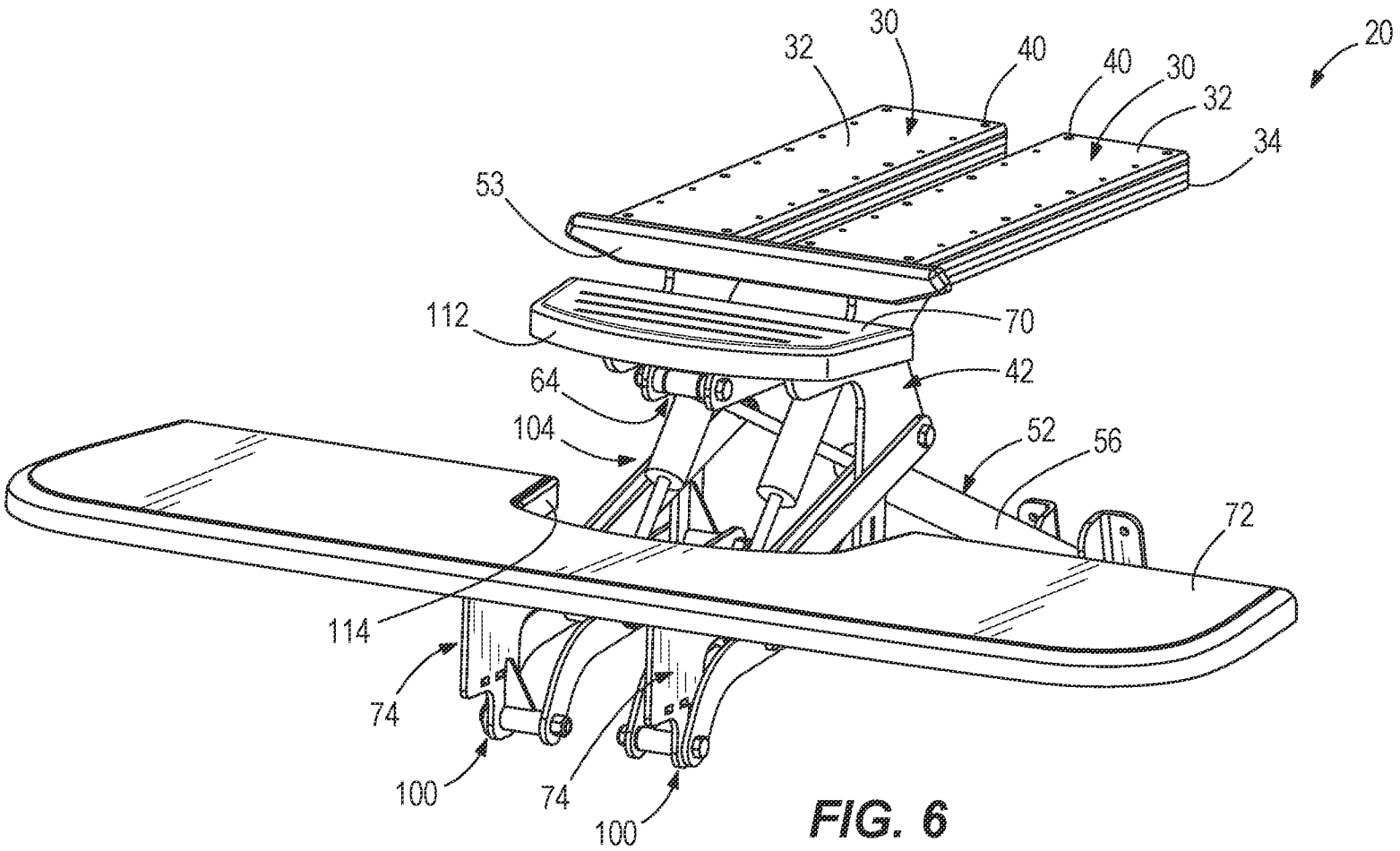
FIG. 6 is a perspective view of the modular swim platform assembly in a deployed position.

As shown in FIGS. 6 and 8, when desired, the operator can operate the operator input device 120 to cause the control system 122 to actuate the deployment actuator 104 to extend the linear actuators 106, which pivots the submersible platform 72 downwardly along arc 82 into the deployed position. As described herein above, in the deployed position the submersible platform 72 is in lateral alignment with the base platform 70 so that, as shown in FIG. 7, the inner profile 114 is vertically aligned with the outer profile 112. In this position, the assembly 20 provides an ergonomic step for a swimmer to step down from the base platform 70 to the submersible platform 72, which is typically located under water. In this position, the submersible platform 72 also provides an ergonomic seat on which a swimmer can sit in the water. In this position, the base platform 70 also provides an ergonomic arm rest for the swimmer seated on the submersible platform 72.

Optionally, movement of the deck 28 from the retracted position to the extended position and movement of the submersible platform 72 from the extended position to the deployed position can occur via single actuator and in a one-step, automated process. For example, by manually operating the operator input device 120 the above-described movements of the assembly 20 can be carried based on a single command for example based upon a manual input to a touchscreen or manually holding down a selector switch or button, and/or the like. In the illustrated example having hydraulic actuators, only one hydraulic pump is needed as the extension actuator 52 and the deployment actuator 104 can be connected in series via a set of overpressure valves. This allows the operator to activate the platform with one button and when it reaches the full extended position it would automatically begin to lower to the desired depth in a continuous motion. To retract the assembly 20, the operator would activate the button to raise the submersible platform 72 would be raised raise to its full height shown in FIG. 5 and then retract again to the retracted position shown in FIG. 4.

Viewed in series, FIGS. 8-10 show movement of the assembly 20 from the deployed position (FIG. 8) to the extended position (FIG. 9) and then to the retracted position (FIG. 10). As described above, these movements can be automated based upon an input to the operator input device 120, and movement optionally can be fluid from one position to the next depending on the input.

Advantageously, the present disclosure provides examples of modular swim platform assemblies that are compact and configured for implementation on boats having one or more marine drives in an ergonomic and space-saving arrangement. The illustrated example can be efficiently implemented on the stern of a boat having twin stern drive units, as shown, without interfering with performance.

The present disclosure thus provides embodiments of boats and modular swim platform assemblies for boats. The modular swim platform assemblies comprise a deck that is movable relative to the hull into and between a retracted position in which the deck is under the hull and an extended position, wherein the deck is extended away from the hull and provides an extended platform on which an occupant of the boat can stand. The deck comprises a base platform and a submersible platform, the submersible platform being movable out of the extended position with the base platform remaining in the extended position, and particularly the submersible platform being movable out of the extended position to a deployed position below the base platform. In the deployed position, the submersible platform provides a seat for the occupant to sit in the water and the base platform provides an armrest for the occupant. The deck slides into and between the retracted position and the extended position and wherein the submersible platform is pivotable relative to the base platform into and between the extended position and the deployed position. A pivot linkage couples the submersible platform to the base platform so that the base platform and the submersible platform are movable together into and between the retracted position and the extended position, and further so that the submersible platform is movable relative to the base platform into and between the extended position and deployed position. The base platform has an outer perimeter and the submersible platform has an inner perimeter that is aligned with the outer perimeter of the base platform both when the submersible platform is in the extended position and when the submersible platform is in the deployed position. An actuator system controls automatic movement of the deck from the retracted position into the extended position and then controls automatic movement of the submersible platform from the extended position into the deployed position. The operator input device further controls automatic movement of the submersible platform from the deployed position to the extended position and then controls automatic movement of the deck from the extended position to the retracted position.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus<10% of the particular term and "substantially" and "significantly" will mean plus or minus>10% of the particular term.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A modular swim platform assembly for a boat, the modular swim platform assembly comprising:

a deck that is slidable relative to the boat into and between a retracted position and an extended position, wherein the deck is located closer to the boat in the retracted position than the extended position, and wherein the deck comprises a base platform and a submersible platform, which together provide a planar surface that remains contiguous as the deck is moved into and between the retracted position and the extended position, the submersible platform being movable out of the extended position to a deployed position while the base platform remains in the extended position, wherein in the deployed position the submersible platform is below and extends parallel to the base platform.

2. The modular swim platform assembly according to claim 1, further comprising a slide rail for supporting the deck relative to the boat and facilitate sliding of the deck relative to the boat.

3. The modular swim platform assembly according to claim 2, wherein the slide rail is one of opposing slide rails disposed on opposing first and second sides of the deck.

4. The modular swim platform assembly according to claim 1, further comprising an extension actuator configured to automatically move the deck into and between the retracted position and the extended position.

5. The modular swim platform assembly according to claim 4, wherein the extension actuator comprises a linear actuator.

6. The modular swim platform assembly according to claim 5, wherein the linear actuator has a first end configured to pivotably couple to the boat and an opposite, second end pivotably coupled to the deck.

7. The modular swim platform assembly according to claim 1, wherein the submersible platform is pivotable relative to the base platform into and between the extended position and the deployed position.

8. The modular swim platform assembly according to claim 7, further comprising a pivot linkage that couples the submersible platform to the base platform so that the base platform and the submersible platform are movable together into and between the retracted position and the extended position, and further so that the submersible platform is movable relative to the base platform into and between the extended position and the deployed position.

9. The modular swim platform assembly according to claim 1, further comprising an operator input device that controls automatic movement of the deck from the retracted position into the extended position and then controls automatic movement of the submersible platform from the extended position into the deployed position, and wherein the operator input device further controls automatic movement of the submersible platform from the deployed position to the extended position and then controls automatic movement of the deck from the extended position to the retracted position.

10. A modular swim platform assembly for a boat, the modular swim platform assembly comprising:

a deck that is movable relative to the boat into and between a retracted position and an extended position, wherein the deck is located closer to the boat in the retracted position than the extended position, and wherein the deck comprises a base platform and a submersible platform, the submersible platform being movable out of the extended position to a deployed position that is below the base platform while the base platform remains in the extended position, wherein the base platform has an outer profile and wherein the submersible platform has an inner profile that is vertically aligned with the outer profile both when the submersible platform is in the extended position, so as to provide a contiguous platform surface in the extended position, and when the submersible platform is in the deployed position so as to provide an arm rest for an occupant seated on the submersible platform.

11. The modular swim platform assembly according to claim 10, wherein the outer profile has a semi-circular shape and wherein the inner profile has a semi-circular shape that follows the semi-circular shape of the outer profile.

12. The modular swim platform assembly according to claim 10, further comprising a pivot linkage that couples the submersible platform to the base platform so that the base platform and the submersible platform are movable together into and between the retracted position and the extended position, and further so that the submersible platform is pivotable relative to the base platform into and between the extended position and the deployed position, wherein the pivot linkage is configured such that the submersible platform is pivoted along an arc from the extended position, initially downwardly and outwardly from the base platform and then downwardly and back inwardly towards the base platform.

13. The modular swim platform assembly according to claim 12, wherein the pivot linkage comprises a pivot arm that facilitates pivoting of the submersible platform.

14. The modular swim platform assembly according to claim 13, wherein the pivot arm is one of opposing first pivot arms and opposing second pivot arms.

15. The modular swim platform assembly according to claim 14, wherein each first pivot arm has an inner end portion that is pivotably coupled to the base platform at a first inner pivot point and an outer end portion that is pivotably coupled to the submersible platform at a first outer pivot point.

16. The modular swim platform assembly according to claim 15, wherein the second pivot arms have inner end portions that are pivotably coupled to the base platform at a second inner pivot point and outer end portions that are pivotably coupled to the submersible platform at a second outer pivot point.

17. The modular swim platform assembly according to claim 16, wherein the first inner pivot point is located above the second inner pivot point and wherein the first outer pivot point is located above the second outer pivot point.

18. The modular swim platform assembly according to claim 17, wherein the first inner pivot point is located forwardly of the second inner pivot point and wherein the first outer pivot point is located forwardly of the second outer pivot point.

19. A modular swim platform assembly for a boat, the modular swim platform assembly comprising:

a deck that is movable relative to the boat into and between a retracted position and an extended position, wherein the deck is located closer to the boat in the retracted position than the extended position, the deck comprising a base platform and a submersible platform, the submersible platform being pivotable out of the extended position to a deployed position below the base platform while the base platform remains in the extended position, and a pivot linkage that couples the submersible platform to the base platform so that the base platform and the submersible platform are movable together into and between the retracted position and the extended position, and further so that the submersible platform is movable relative to the base platform into and between the extended position and the deployed position, wherein the pivot linkage comprises opposing first pivot arms and opposing second pivot arms that facilitate pivoting of the submersible platform, a base frame fixed to the base platform, and a submersible frame fixed to the submersible platform, and further wherein the opposing first pivot arms and opposing second pivot arms are pivotably coupled to the base frame and the submersible frame, and wherein the pivot linkage is configured such that the submersible platform pivots out of the extended position along an arc, initially downwardly and outwardly from the base platform and then downwardly and back inwardly towards the base platform.

20. A modular swim platform assembly for a boat, the modular swim platform assembly comprising:

a deck that is movable relative to the boat into and between a retracted position and an extended position, wherein the deck is located closer to the boat in the retracted position than the extended position, the deck comprising a base platform and a submersible platform, the submersible platform being pivotable out of the extended position to a deployed position below the base platform while the base platform remains in the extended position, and a pivot linkage that couples the submersible platform to the base platform so that the base platform and the submersible platform are movable together into and between the retracted position and the extended position, and further so that the submersible platform is movable relative to the base platform into and between the extended position and the deployed position, wherein the pivot linkage comprises opposing first pivot arms and opposing second pivot arms that facilitate pivoting of the submersible platform, a base frame fixed to the base platform, and a submersible frame fixed to the submersible platform, and further wherein the opposing first pivot arms and opposing second pivot arms are pivotably coupled to the base frame and the submersible frame, wherein the opposing first pivot arms each comprise an elongated upwardly curved bar and wherein the opposing second pivot arms each comprise an elongated downwardly curved bar.

21. A modular swim platform assembly for a boat, the modular swim platform assembly comprising:

a deck that is movable relative to the boat into and between a retracted position and an extended position, wherein the deck is located closer to the boat in the retracted position than the extended position, the deck comprising a base platform and a submersible platform, the submersible platform being pivotable out of the extended position to a deployed position below the base platform while the base platform remains in the extended position, a pivot linkage that couples the submersible platform to the base platform so that the base platform and the submersible platform are movable together into and between the retracted position and the extended position, and further so that the submersible platform is movable relative to the base platform into and between the extended position and the deployed position, wherein the pivot linkage comprises opposing first pivot arms and opposing second pivot arms that facilitate pivoting of the submersible platform, a base frame fixed to the base platform, and a submersible frame fixed to the submersible platform, and further wherein the opposing first pivot arms and opposing second pivot arms are pivotably coupled to the base frame and the submersible frame, and a deployment actuator configured to automatically move the submersible platform into and between the extended position and the deployed position.

22. The modular swim platform assembly according to claim 21, wherein the deployment actuator comprises a linear actuator having a first end pivotably coupled to the base platform and a second end pivotably coupled to the submersible platform.

23. The modular swim platform assembly according to claim 22, wherein the linear actuator comprises a first end pivotably coupled to a base frame on the base platform and a second end pivotably coupled to a submersible frame on the submersible platform, and wherein the first end is positioned vertically higher than the second end.

24. The modular swim platform assembly according to claim 23, wherein the linear actuator is one of a pair of linear actuators.

25. A boat comprising:

a hull, and a modular swim platform comprising a deck that is movable relative to the hull into and between a retracted position in which the deck is under the hull and an extended position in which the deck is extended away from the hull and provides an extended platform on which an occupant of the boat can stand, wherein the deck comprises a base platform and a submersible platform which together provide a planar surface that remains contiguous as the deck is moved into and between the retracted position and the extended position, the submersible platform being movable out of the extended position to a deployed position below the base platform while the base platform remains in the extended position, and wherein in the deployed position, the submersible platform provides a seat for the occupant to sit in a body of water in which the boat is operated, and the base platform provides an armrest for the occupant.

26. The boat according to claim 25, wherein the deck slides into and between the retracted position and the extended position and wherein the submersible platform is pivotable relative to the base platform into and between the extended position and the deployed position.

27. The boat according to claim 26, further comprising a pivot linkage that couples the submersible platform to the base platform so that the base platform and the submersible platform are movable together into and between the retracted position and the extended position, and further so that the submersible platform is movable relative to the base platform into and between the extended position and the deployed position.

28. A boat comprising:

a hull, and a modular swim platform comprising a deck that is movable relative to the hull into and between a retracted position in which the deck is under the hull and an extended position in which the deck is extended away from the hull and provides an extended platform on which an occupant of the boat can stand, wherein the deck comprises a base platform and a submersible platform, the submersible platform being movable out of the extended position with the base platform remaining in the extended position, the submersible platform being movable out of the extended position to a deployed position located below the base platform, wherein in the deployed position, the submersible platform provides a seat for the occupant to sit in a body of water in which the boat is operated and the base platform provides an armrest for the occupant, and wherein the base platform has an outer profile and wherein the submersible platform has an inner profile that is aligned with the outer profile of the base platform both when the submersible platform is in the extended position and when the submersible platform is in the deployed position.

29. The boat according to claim 28, further comprising an actuator system that controls automatic movement of the deck from the retracted position into the extended position and then controls automatic movement of the submersible platform from the extended position into the deployed position, and further controls automatic movement of the submersible platform from the deployed position to the extended position and then controls automatic movement of the deck from the extended position to the retracted position.

* * * * *